United States Patent [19]

Seitz

[11] 4,227,613

[45] Oct. 14, 1980

[54] LID FOR GOODS DISPATCH CONTAINER

[76] Inventor: Peter Seitz, Ledderhose Weg, 6550 Bad Kreuznach, Fed. Rep. of Germany

[21] Appl. No.: 918,980

[22] Filed: Jun. 26, 1978

[30] Foreign Application Priority Data

Jun. 25, 1977 [DE] Fed. Rep. of Germany ..... 2728734

[51] Int. Cl.[3] ..... B65D 43/03; B65D 73/00; G09F 3/20

[52] U.S. Cl. ..... 206/459; 40/307; 116/321; 198/349; 198/353; 220/380

[58] Field of Search ..... 116/321, 323, 324; 206/459; 40/307, 311, 313, 491; 220/380; 198/348, 349, 353

[56] References Cited

U.S. PATENT DOCUMENTS

| | | | |
|---|---|---|---|
| 1,415,388 | 5/1922 | Pelot | 40/313 |
| 1,872,649 | 8/1932 | Berg | 206/565 |
| 2,231,364 | 2/1941 | Mainzer | 40/307 |
| 2,508,086 | 5/1950 | Alvarez | 198/355 |
| 3,227,886 | 1/1966 | Dunigan et al. | 198/349 X |
| 3,365,056 | 1/1968 | Mandel | 206/459 |
| 3,480,177 | 11/1969 | Elliot | 220/380 X |
| 3,560,073 | 2/1971 | Knapp | 198/349 |
| 3,974,916 | 8/1976 | Bartolucci | 206/459 |
| 3,990,752 | 11/1976 | Hoffman et al. | 206/459 X |
| 4,117,615 | 10/1978 | Gomolak | 40/491 X |
| 4,119,200 | 10/1978 | Cassidy et al. | 206/459 X |

FOREIGN PATENT DOCUMENTS

| | | | |
|---|---|---|---|
| 2646064 | 4/1978 | Fed. Rep. of Germany | 198/348 |

*Primary Examiner*—Daniel M. Yasich
*Attorney, Agent, or Firm*—Webb, Burden, Robinson & Webb

[57] ABSTRACT

A goods dispatch container having a superimposed lid for the dispatch of goods from the wholesale warehouse to the customer having two rows of ten marking points on the upper side of the lid which are provided with symbols and two are identified with additional marking pieces.

3 Claims, 2 Drawing Figures

LID FOR GOODS DISPATCH CONTAINER

The invention relates to a lid for a goods dispatch container which is used in shipping goods from the wholesale warehouse to the customer.

The goods dispatch containers, also called shipping containers can be of a design similar to that disclosed in German Gebrauchsmuster No. 19 80 635. These containers may have their own system of coding for identifying their shipping destinations. However, when the individual goods dispatch containers have been filled with the goods intended for them and the commissioning operation is thereby concluded, the coding means which accompanies the goods dispatch container during the commissioning is removed and replaced by a lid which closes the upwardly open goods dispatch container. This lid might also mask any other coding system which is arranged on the goods dispatch container and which served its purpose upon the preceding commissioning. However, the filled goods dispatch containers closed with the transportation lid accrue in a wholesale warehouse in such large numbers with different dispatch addresses that the grouping and distribution of the filled closed goods dispatch containers to the delivery trucks is a very time-consuming job. If the filled goods dispatch containers are transported stacked one on top of the other on a delivery truck, then the necessity arises of stacking the individual goods dispatch containers on top of one another in such a way that they can be unloaded one after the other from top to bottom in accordance with the course of the delivery journey and the sequence of the customers to be supplied.

The invention will facilitate considerably this work of grouping and arranging the filled goods dispatch containers for preparation for dispatch.

This problem is solved, in the case of a goods dispatch container having a superimposed lid of the kind mentioned previously, in accordance with the invention in that arranged on the upper side of the lid are two rows of ten marking positions, each of which is provided with corresponding indicia such as decimal numbers, letters of the alphabet or the like, and of which in each case two are identified by the use of marking pieces.

Thus each lid has a coding system of its own which makes the various destinations and several dispatch containers belonging to one customer and one delivery tour recognisable.

The marking positions corresponding to the indicia at which the marking pieces are positioned may advantageously consist of notches in the walls or grooves formed in the upper surface of the lid, and the marking pieces may consist of flat rectangular chips which are displaceable within the grooves.

Preferably, the grooves are of sufficient depth such that the upper faces of the marking pieces are flush with the upper surface of the lid.

The marking pieces may have, on the edge adjacent the wall of the groove having the notches, a pair of elastic arms which carry a cam for engaging the notches in the walls of the grooves on the opposite edge, two elastic supporting arms are attached to and extend from the marking piece to urge against the opposite wall of the groove.

On the upper surface of the lid there can advantageously be arranged, at the four corner points, upwardly protruding angle ledges which permit stacking of lids so that they are centered one on top of the other.

One embodiment of the invention will be explained in more detail hereinafter with reference to the drawings, in which.

Figure 2:
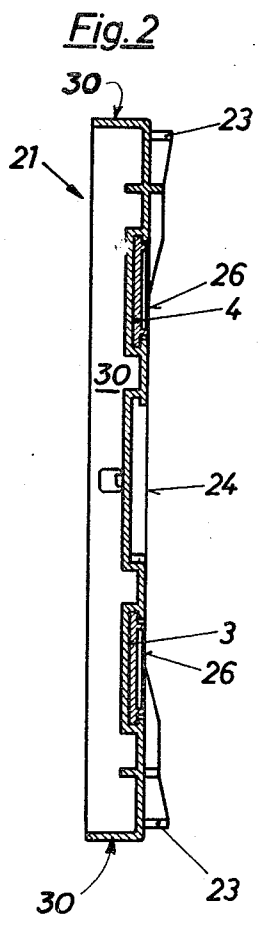
FIG. 2 shows a cross-section taken along the line of section I-I in FIG. 1.
Figure 1:
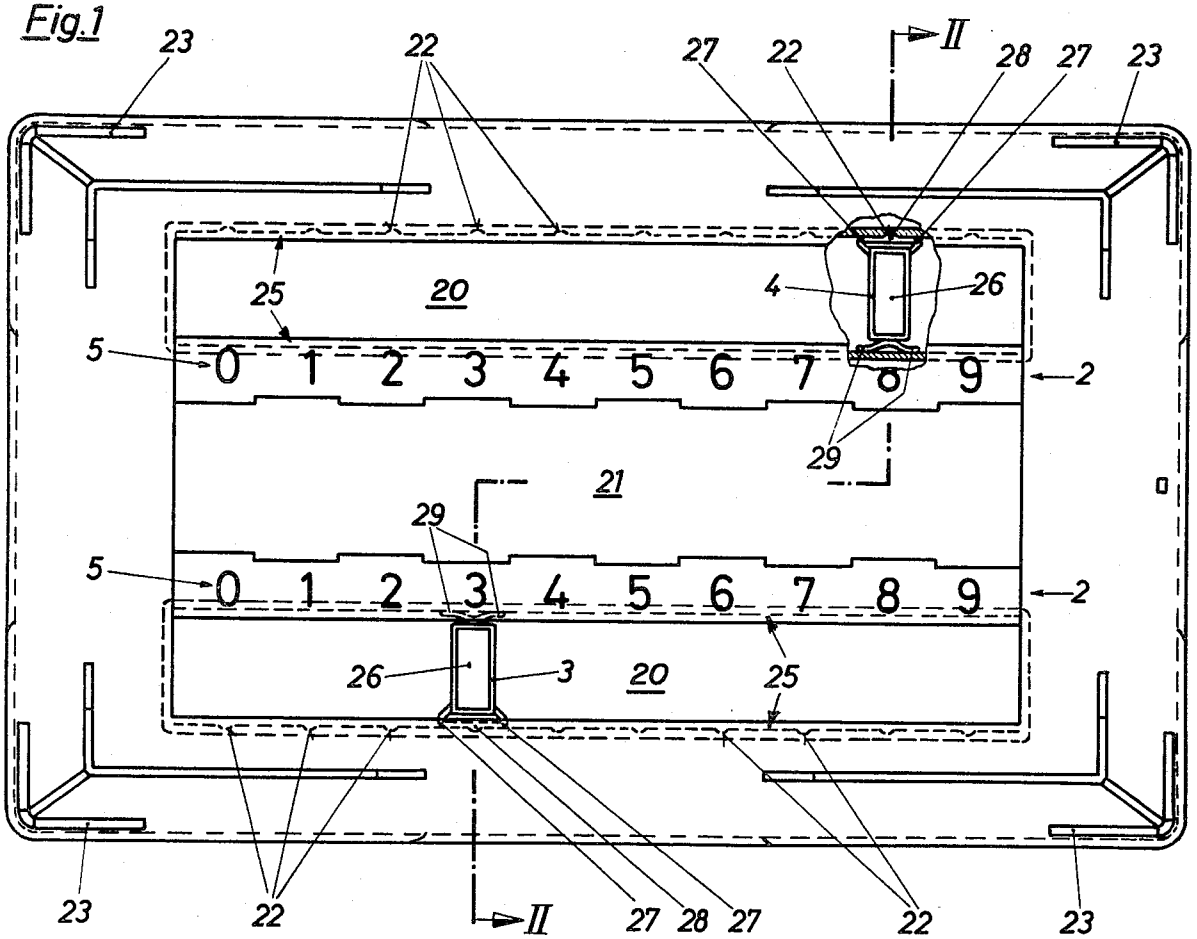
FIG. 1 shows the lid in top plan view.

The lid 21 shown in FIG. 1 has, on its upper surface 24, two rows 2, 2 of numerals 5, 5 which may also be replaced by other indicia such as letters of the alphabet or the like. Associated with each of the numerals 5 in these two rows are marking positions which are likewise arranged in two rows, each row of marking positions adjacent a row of numerals 5. The marking positions consist, in the case of the example shown here of notches 22 in the walls 25 of two parallel grooves 20. Two marking pieces 3, 4 in the form of flat rectangular chips, each having an appropriately shaped cam 28 for engaging the notches 22, may be inserted into a groove 20. Each cam 28 is carried by two elastic arms 27, 27 extending from a side of a marking piece 3, 4 adjacent a wall 25 of a groove 20. Two elastic supporting arms 29, 29 extend from the opposite side of the marking piece 3, 4, and abut the opposite wall 25 of the groove 20.

Thus, a two character number or code can be displayed on the lid 21 by sliding each marking piece 3, 4 along its groove 20 until its cam 28 engages a notch 22 in the wall 25 of the groove correspondng to the predetermined numeral 5. By arbitrary commutation of these marking pieces 3, 4, ninety-nine different delivery destinations can be coded on the lid 21. The personnel can thus assemble on the loading ramp, prior to the loading of the delivery trucks all those filled goods dispatch containers which bear the same two-place decimal number denoting the destination. It is, of course, also possible to cover the upper face 26 of the marking pieces 3, 4 with light-reflecting foil which is suitable for an optoelectronic read-off.

The lid upper surface 24 forms a uniformly flat surface, since the upper face 26 of each marking pieces 3, 4 is flush with the upper surface 24. The entire coding system is thus accomodated in countersunk manner in the lid upper surface 24, so that upon the transporting back of the empty goods dispatch containers the lids 21 can be stacked one on top of the other separately from the goods dispatch containers, since the goods dispatch containers are for their part likewise transported back fitted into one another.

The lid 21 may be formed with a lip 30 at its outer periphery.

The stacking of the lids 21 one on top of the other is enhanced in that arranged at the four corner points of the lid upper surface 24 are upwardly protruding angle ledges 23 which are spaced a distance from the periphery of the upper surface to abut the lip 30 of a lid 21 stacked above it thereby locking in centering manner the lids 21 when stacked one on top of the other.

I claim:

1. A lid used to cover a goods dispatch container comprising:

a flat surface, substantially parallel opposing recessed walls extending from said flat surface, defining at least one rectangular groove, marking indicia located on the flat surface adjacent to and spaced along said groove;

at least one rectangular marking piece shaped to fit within the groove and of a size such that it can be positioned adjacent only one marking indicia at a time, and of a thickness so that it fits within the groove to be flush with the flat surface;

at least one pair of resilient support arms attached to an end of the marking piece adjacent a wall of a groove and urging against the wall of the groove;

a lip extending about the periphery of the flat surface and protruding in a direction normal to the flat surface for engaging the outer periphery of the open end of the goods dispatch container; and at least one raised ledge portion on one of the sides of said flat surface and conforming to the periphery of the flat surface and extending at a distance from the periphery of the flat surface greater than that of the lip such that lids may be stacked so that the flat surfaces are substantially parallel to one another and the lip of a first lid rests upon the flat surface of a second lid below it and the lip of the first lid abuts the exterior surface of the raised ledge of the second lid below it.

2. The lid of claim 1 wherein a wall of the grooves further defines notches in one-to-one correspondence with the marking indicia and wherein the resilient support arms include a cam sized to matingly engage a notch such that the marking piece can more easily be positioned adjacent a marking indicia.

3. The lid of claim 1 wherein the rectangular marking piece includes a second set of resilient support arms attached to an opposite end of the marking piece for urging against an opposite wall of the groove.

* * * * *